United States Patent [19]

Butch

[11] Patent Number: 4,793,730

[45] Date of Patent: Dec. 27, 1988

[54] ASPHALT SURFACE RENEWAL METHOD AND APPARATUS

[76] Inventor: Adam F. Butch, P.O. Box 916, Casselberry, Fla. 32707

[21] Appl. No.: 639,745

[22] Filed: Aug. 13, 1984

[51] Int. Cl.[4] ..... E01C 7/06; E01C 23/12; E01C 23/14

[52] U.S. Cl. ..... 404/77; 404/79; 404/91; 404/95; 404/92

[58] Field of Search ..... 404/75, 77, 79, 90, 404/91, 92, 95, 120, 121; 299/39; 126/271.2 A

[56] References Cited

U.S. PATENT DOCUMENTS

| | | | |
|---|---|---|---|
| 3,055,280 | 9/1962 | Neville | 404/95 |
| 3,066,582 | 12/1962 | Cutler | 404/95 |
| 3,361,042 | 1/1968 | Cutler | 404/77 |
| 3,732,023 | 5/1973 | Rank et al. | 404/90 |
| 3,997,276 | 12/1976 | Jackson, Sr. | 404/77 |
| 4,124,325 | 11/1978 | Cutler | 404/75 |
| 4,172,679 | 10/1979 | Wirtgen | 404/90 |
| 4,226,552 | 10/1980 | Moench | 404/75 X |
| 4,252,487 | 2/1981 | Jeppson | 404/77 |
| 4,261,669 | 4/1981 | Edo | 404/77 |

FOREIGN PATENT DOCUMENTS

| | | | |
|---|---|---|---|
| 2362968 | 3/1978 | France | 404/95 |
| 444693 | 3/1936 | United Kingdom | 126/271.2 A |

*Primary Examiner*—Jerome W. Massie
*Assistant Examiner*—John F. Letchford

[57] ABSTRACT

A method and apparatus for renewing the surface of asphaltic paving at low cost and for immediate reuse. The asphalt surface is heated to about 300°-500° F. The surface is broken to a depth of about two inches and the lower material thoroughly mixed in situ with the broken surface material. After mixing, the material is further heated to fuse the heated mixture into a homogeneous surface. The surface is screeded for leveling and compacted by a road roller. A road machine is disclosed having a steam manifold for heating the asphalt, transversely reciprocating breaker bars having teeth adjusted to the depth desired, toothed mixing cylinders for mixing the broken material, and a second steam manifold for reheating the mixed material. Reciprocating screed bars on the road machine level the mixed and heated material. Final compacting may be done with a conventional road roller.

12 Claims, 2 Drawing Sheets

ASPHALT SURFACE RENEWAL METHOD AND APPARATUS

BACKGROUND OF THE INVENTION

1. Field of the Invention

This invention generally relates to reworking of asphalt road surfaces and more particularly to a method and apparatus for renewing the surface of asphaltic paving at low cost for immediate reuse.

2. Description of the Prior Art

The use of asphalt for paving of highways, parking areas and the like is widespread since this material provides an effective and relatively low cost surface. However, such surfaces have a limited lifetime due to problems from heat generated by traffic and weathering. For example, the top surface of an asphalt pavement may become highly oxidized or polmerized due to these heat sources. When this occurs, the normal resiliency of the asphalt is materially affected, followed by cracking and breaking of the surface. This action produces holes and irregularities in the paved surface and eventually leads to a requirement for repaving or reworking of the surface. It is known to break up damaged asphalt paving surfaces, transport the material to a plant for reprocessing and adding of new asphalt, and thereafter relaying the surface. While somewhat lower cost than repaving with all new material, the cost of such method is relatively high and time consuming, requiring removal of the roadway from service.

In the prior art, a number of methods have been proposed and utilized to renew asphaltic paving surfaces without the necessity of completely rebuilding or replacing the surface. These known processes generally include the addition of new asphalt or other similar materials, rejuvenating compounds, and the like. Also such processes involve picking up of the broken asphalt into a chamber or device for rejuvenation and replacing the material on a reworked road bed.

It is also known to rework the asphalt in situ, however, all known in situ processes involve the use of new material such as rejuvenating liquids, fresh asphalt, lime rock, and numerous other materials.

For example, Neville in U.S. Pat. No. 3,055,280 teaches a means for treating an asphalt pavement by use of a liquid reconditioning agent disclosing a "rake" device to work the surface to obtain penetration of the reconditioning agent. The crux of the Neiille patent is the use of highly penetrative radiant energy to make the asphalt highly receptive to the liquid reconditioning agent.

U.S. Pat. No. 4,261,669 to Edo teaches a steam heating means for rejuvenation, the method disclosed involves scooping up cut-up asphalt, heating in a heat chamber, and thereafter discharging the salvaged material in the form of sludge.

A patent to Jackson, Sr., U.S. Pat. No. 3,997,276, uses burner units which have the deleterious effect of further oxidizing the surface asphalt. Jackson contemplates machine for evening out distortions and irregularities; planing off oxidized and brittle portions before resurfacing; scarifying the surface preparatory to resurfacing; applying a rejuvenating agent and new resurfacing material; and compaction.

Rank et al, U.S. Pat. No. 3,732,023, disclose apparatus which processes old asphalt by mixing with lime, cement, or emulsified asphalt to produce a new base for a new road surface.

U.S. Pat. No. 1,952,452 to Monroe discloses means for planing and grading asphalt-type road surfaces after heating and scarifying. A major difficulty with the Monroe approach is that only the surface of the roadway is broken up or scarified and the heated material is simply scraped for leveling. Therefore, such an approach does little more than smooth out surface irregularities and does nothing to actually renew the surface.

In U.S. Pat. No. 3,989,401 to Moench, apparatus is described which scarifies the heated surface of the roadway which is then leveled by a screed device. In this patent, temperatures of 2400° F. are required for operation of the apparatus. Unfortunately, these high temperatures tend to further degrade the asphaltic material. Other patents, such as U.S. Pat. No. 4,124,325 and No. 4,172,679, teach the renewing of asphaltic roadway surfaces by breaking up the old surface and generally mixing new materials with the older materials and redistributing the supplemented material over the roadway. Thus, this approach has the disadvantage of additional cost of fresh material plus the requirement for mixing the new materials and the materials to be reused.

SUMMARY OF THE INVENTION

I have determined that the basic problems with asphalt paving surfaces stem from the deterioration of a small surface thickness of material which becomes oxidized or polymerized due to weathering. When this occurs, the normally resilient materials may begin to crack, forming irregularities and holes which, through normal weather variations and traffic conditions, cause the surface to continue to degrade. I have also found that the normal percentage of surface degraded material is quite small compared to the total asphalt used in the roadbed. As described above, a number of attempts have been made to reuse the asphalt by breaking up the surface, scraping away the oxidized asphalt or mixing in fresh materials, and similar approaches, none of which have been very successful. A major problem with prior art approaches arises from the use of flame type burners to produce heat for softening of the asphalt. The high burner temperatures and high temperatures produced in the asphalt contribute to additional oxidation and polymerization of the asphalt. I have determined that the very high temperatures commonly used are not necessary and that lower temperatures, for example not over 700° F., are satisfactory. Temperatures in this range may be generated with steam from a steam boiler. These lower temperatures will sufficiently soften the surface of an asphalt pavement to permit regeneration, but will not produce additional degradation.

My novel method of resurfacing asphalt paving includes the following steps:

(1) The roadway surface is heated above 200° F. and preferably in the range of 300°-500° F.

(2) The surface of the asphalt is broken through by suitable means generally to a depth of about two inches. This step produces broken pieces of asphalt which are in the material's original resilient condition since the degraded surface portions seldom exceed a thickness of about ¼ inch.

(3) Toothed cylinders pick up the broken asphaltic material and, through a mixing action, thoroughly mix the small volume of degraded top surface material in situ with the fresh lower portions of the roadway.

(4) After the mixing action produced by the toothed cylinders, the material is subjected to additional heating to permit fusing of the heated mixture into a homogeneous surface.

(5) Screed boards then are utilized to level the remixed and reheated surface.

(6) Finally, a conventional road roller compacts the smooth- mixed and reheated material into a renewed resilient roadway surface. As may now be understood, the small amount of degraded surface materials is thoroughly mixed with lower fresh material to form a part of the binder or inert portions of the asphalt. A fresh, fully resilient asphalt surface is then exposed to the vehicular traffic. Due to the relatively low temperatures used, the roadway can be placed in use very quickly after resurfacing.

The successful accomplishment of the above steps is made possible by a novel roadway machine in accordance with the invention. Although the various operations described can be accomplished with a number of known mechanical arrangements, an energy saving, low cost machine may incorporate an elongated truck bed having a cab and driving engine at the forward end. The engine is preferably a diesel type. At the forward end of the machine, I first provide an exhaust manifold which directs the hot exhaust from the truck engine to preheat the asphalt. Next, a propane burner is provided for burning off the oil film which will not mix with the asphalt. The burner is controlled in intensity for the forward velocity of the machine so as to prevent any additional oxidation from taking place although it adds useful heat to the asphalt. Following the burner is a steam manifold. The steam manifold is sized to cover a desired area of a roadway, for example, from 10 to 15 feet in width. The manifold is surrounded by a flexible plastic or similar skirt which serves to minimize leakage of the steam. In operation, this manifold is lowered to the point where the encircling skirt just contacts the roadway surface. A steam boiler mounted on the chassis of the vehicle provides the desired steam to the manifold at pressures which will produce the desired asphalt temperatures in the 400° F. range to a depth of 2–3 inches. The machine will be driven along one lane of a roadway at a rate sufficient to produce the desired heating. As will be understood, the steam temperature required will be a function of the rate which the machine is driven down the roadway.

Next, a set of breaker bars is provided and disposed immediately behind the steam manifold. The breaker bars reciprocate laterally across the roadbed as the apparatus moves forward. These breaker bars have a series of downwardly depending teeth and are hydraulically controlled to adjust the depth at which the teeth are permitted to penetrate the asphalt surface. Generally, a distance of about two inches has been found sufficient. As the breaker bars reciprocate laterally and the machine moves forward, the asphalt surface is scarified and broken up into relatively small pieces.

It should be noted at this point that the breaker bars perform the function of breaking up the softened asphalt, but maintaining essentially the same stratification. That is, the degraded material at the surface essentially remains at the surface while the fresh, resilient asphalt lower in the bed tends to remain at that level.

Therefore, I follow the breaker bars with a set of mixing cylinders. These mixing cylinders may be formed from a pair of lateral cylinders extending the width of the machine chassis. Each cylinder has interlocking rows of dependent teeth. The cylinder assemblies may be raised and lowered, dependent upon the depth to which the asphalt has been broken. Thus, the dependent teeth will normally be adjusted to extend to the deepest points of the breaker bar setting. These cylinders rotate at a relatively low rate, such as one to two rpm, as the apparatus moves along the roadway with the optimum rate determined by the heat available and the forward speed of the machine. The teeth of the mixing cylinders pick up the broken asphalt pieces and thoroughly mix the materials such that the small amounts from the degraded top surface material are intimately mixed with the greater volume of fresher, lower materials. As the machine progresses along the roadway, the mixed material is deposited to the rear of the mixing cylinders.

Just to the rear of the mixing cylinders, I provide a second steam manifold similar to the forward steam manifold having a surrounding skirt for minimizing the heat loss. Steam from this manifold is directed onto the mixed asphaltic material to bring the temperature back to the optimum value in the range of 300°–500° F. Immediately behind the second steam manifold is an exhaust manifold which utilizes hot exhaust gases from a second engine used to drive the breaker bars and mixing cylinders. To the rear of this manifold is a set of laterally reciprocating screed bars which are adjustable and serve to smooth and flatten the mixed asphalt as is conventional.

The various mechanical devices just described are controllable from the cab of the machine and may be driven from the prime mover through a suitable power take-off, or alternatively, a diesel engine may be mounted on the rear of the chassis for operating the various mechanical devices. A hydraulic system ma be coupled to the diesel engine for controlling the depth and settings of the various devices. To provide a minimum operating cost for the machine of the invention, I utilize most of the normally wasted heat from the diesel engines and steam boiler to perform useful work. For example, the manifold attached to the driving engine exhaust manifold permits directing of the hot exhaust gas onto the pavement surface immediately ahead of the steam manifold prior to any other operations, thus recovering otherwise lost heat. Where a separated diesel engine is utilized for operating the system, the manifold extending across the width of the chassis is connected to that engine exhaust and disposed immediately to the rear of the screed bars and provides additional heat as mentioned above. Thus, waste heat from this engine is directed onto the screeded asphalt to maintain its temperature for rolling. I also connect the flue gas stack from the steam boiler to the two exhaust gas manifolds to utilize the heat from the combustion gases.

Immediately following the machine as it moves along the roadway is a conventional road roller or the like to compress and smooth the newly surfaced roadway.

Due to the relatively low temperatures of the surface after rolling, it may be recognized that the roadway or paved surface may be quickly put back into service. Therefore, my apparatus permits resurfacing of parking lots, roads, and the like without removing the areas from service for extended periods of time as has been necessary in the prior art.

It is, therefore, a principal object of my invention to provide an improved method for renewing the surface of asphalt roadways and the like without the necessity of breaking up the asphalt, transporting to a processing plant, adding new materials and, in effect, resurfacing the roadway.

It is another object of my invention to provide apparatus which may be driven down an asphalt topped roadway which will heat and break up degraded surface material and fresh material below the surface, thoroughly mix the fresh material and the degraded material on the roadway, and screed the mixed material to form a fresh surface which may be immediately rolled and put back into use.

It is yet another object of my invention to provide a method and apparatus for resurfacing asphaltic paving surfaces without requirement of new materials to provide a greatly extended roadway surface life at a very low cost.

It is still another object of my invention to provide a method and apparatus for breaking up and rehabilitating an asphalt road surface through the use of relatively low temperatures to prevent further degradation of the asphalt during the operation.

These and other advantages and objects of my invention will become apparent from the following detailed description of the preferred embodiment when read with regard to the drawings.

DETAILED DESCRIPTION OF THE PREFERRED EMBODIMENT

Figure 1:
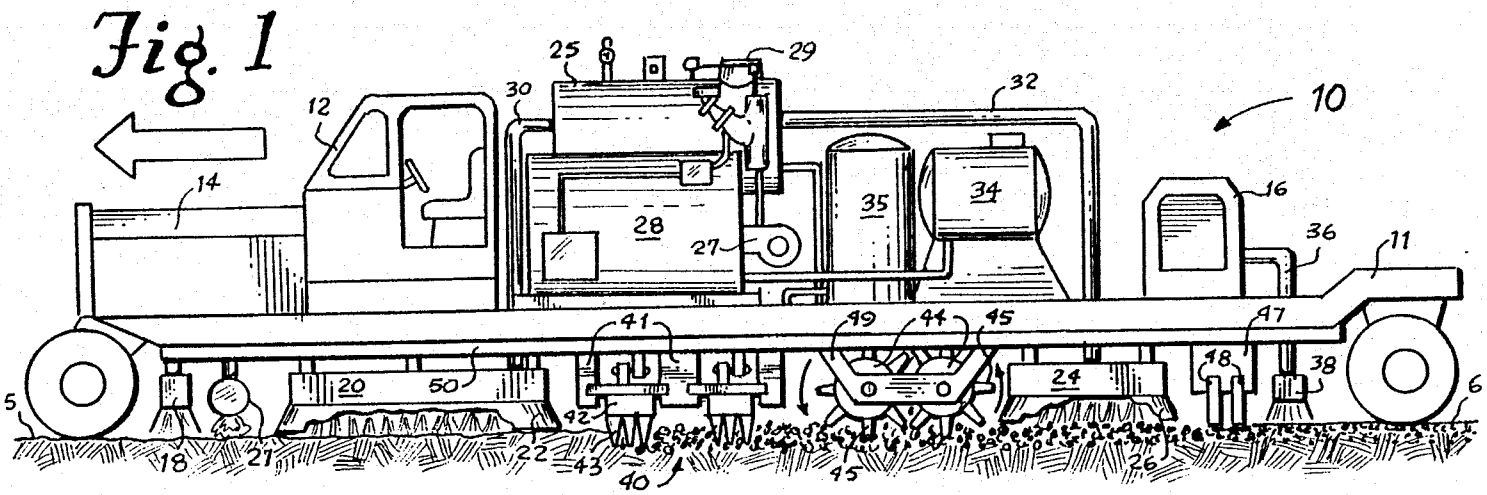
FIG. 1 is a side view of a typical apparatus for practicing the method of my invention showing a vehicle chassis having a driving engine, a steam boiler, and a system operating engine mounted thereon with the various operative elements used for reclaiming asphaltic road surfaces in accordance with the method of my invention.
Figure 2:
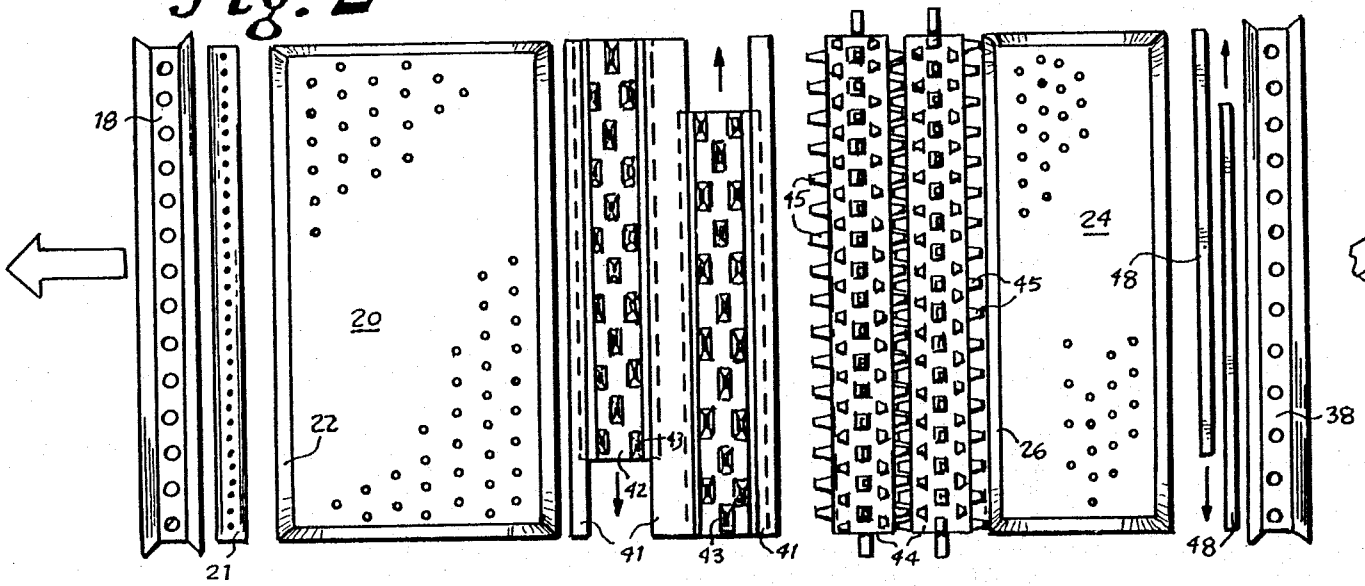
FIG. 2 is a simplified plan view showing the basic operative elements of my invention shown in the apparatus of FIG. 1.

My invention involves the sequential operation of several elements, each of which perform a particular operation in a desired sequence on an asphalt roadway or the like. As will be apparent to those of skill in the art, there are a number of mechanical arrangements which are satisfactory. However, I prefer to utilize a single, self-powered vehicle. A typical vehicle arrangement is shown in side view in FIG. 1 in somewhat simplified form to illustrate the sequence of these elements with FIG. 2 showing a bottom view of the elements.

Apparatus 10 in this exemplary version comprises a truck bed 11 having a diesel engine 14 at its forward end and a cab 12 for the operator. The various elements used to process the asphalt depend from the chassis 11 as shown. These elements will be described in the sequence in which they perform their operations upon an asphalt road 5. First, an exhaust manifold 18 is connected to the exhaust of diesel engine 14 and the hot exhaust gas is directed from manifold 18 to the asphalt surface. While this heat is normally insufficient to greatly raise the temperature of the asphalt 5, it is heat that would otherwise be watted and is here utilized. Immediately to the rear of the exhaust manifold 118 is burner 21. Burner 21 is fed by a propane tank or similar fuel to produce a flame. In accordance with my invention, the flame is adjusted to burn off traffic oil film from the roadway surface and to add additional heat to asphalt 5, but without further oxidation to the surface. Following burner 21 is a steam manifold 20. Manifold 20 includes a flexible skirt portion 22. As will be described in more detail hereinafter, manifold 50 is adjustable vertically such that skirt 22 just contacts the asphalt surface 5. Skirt 22 serves to confine the heat from the steam manifold to the area covered. A packaged unit 28 having a boiler 25 is mounted on the rear of truck chassis 11 and may be any suitable packaged boiler. However, I prefer to utilize a Model HRT-15-250-S-G boiler manufactured by the Columbia Boiler Company of Pottstown having a 15 horsepower rating. Boiler 28 preferably utilizes an oil burner 27 for burning fuel oil which may be stored in tank 34, although LP gas may be used. Water is stored in tank 35. The amount of steam fed to manifold 50 is controlled such that the asphalt will be heated to a temperature in the 300°–500° F. range for a depth of 2–3 inches.

To the rear of manifold 20, I provide a pair of reciprocating breaker bars shown generally at 40 which comprise mounting structure 41, bars 42, and a plurality of pyramidal shaped teeth 43 projecting from bars 42. Breaker bars 40 are adjustable vertically and are adjusted to penetrate the surface of the asphalt a desired depth depending upon the condition of the roadway. For example, a depth of about 2 inches has been found to be generally satisfactory. The reciprocating bars 42 serve to break the softened asphalt into small pieces. To the rear of the breaker bars 40, I provide a set of toothed mixing cylinders 44 having pyramidal shaped teeth 45 projecting therefrom. Mixing cylinders 44 are rotatable mounted on mount 49 and are vertically adjustable. As mixing cylinders 44 rotate in the direction as shown by the arrows, the broken asphalt is picked up by their rotation and the forward movement of the apparatus 10 to thoroughly mix the relatively fresh lower portions of asphalt with the small amount of degraded surface material previously broken up by the breaker bars 40. As may be now understood, the portion of the asphalt pavement 5 to the rear of rotating mixing cylinders 44 will have predominantly fresh asphalt from the below the surface portions and the small amount of degraded and oxidized material from the original surface will be mixed in situ with the fresher material as a binder.

Just to the rear of cylinders 44, I provide a second or rear steam manifold 24, identical in construction to front manifold 20 previously described. Manifold 24 is fed steam from boiler 25 through steam pipe 32. Manifold 24 also utilizes a flexible skirt 26 for maintaining the heat directed to the asphalt. The purpose of manifold 24 is to add heat to the mixed fresh asphalt to compensate for that lost during the breaking up process. Next, to the rear is found screed bars 48 in mount 47. As best seen in FIG. 2, screed bars 48 reciprocate laterally and, as apparatus 10 moves forward, produces a smooth surface from the broken and softened asphalt.

On the rear of truck chassis 11, I provide a second diesel engine 16 for driving the moving parts of he apparatus 10. It will be understood, of course, that a power take-off from the vehicle engine 14 can be used as an alternative source of power for the moving parts of the apparatus 10. Just to the rear of screeds 48, I dispose an exhaust manifold to receive the hot exhaust gases from diesel engine 16 to add extra heat to the screeded surface. It is contemplated that, as is conventional, a road roller will follow apparatus 10 immediately and will smooth the softened asphalt into a finished roadway surface.

Referring particularly to FIG. 2, a bottom view of the apparatus 10 is shown. As may be noted, exhaust manifold 18 includes a chamber having a series of downwardly directed openings for directing the exhaust gases to the pavement surface. Next, burner 21 may be a tubular burner with a multiplicity of burner holes as shown. Steam manifolds 20 and 24 may be formed from a box-like structure having a perforated bottom plate with the steam issuing from the perforations to the pavement surface. The mounting structure for the reciprocating breaker bars support the breaker bar assemblies in slots as indicated to permit the breaker bars to reciprocate laterally as indicated by the arrows. Mixing cylinders 44 are seen in FIG. 2 to have the teeth 45 in a staggered pattern to provide thorough mixing of the broken up asphalt. Screed bars 48 reciprocate laterally in vertical slots in their mount 47 in the directions shown by the arrows. Rear exhaust manifold 38 is identical with manifold 18.

As may now be recognized, my invention requires a driving means to rotate mixing cylinders 44 and to reciprocate breaker bars 42 and screed bars 48. Diesel engine 16 may be coupled to these elements by any suitable and well known means preferably through variable transmissions such that the rate of movement and rate of rotation can be adjusted for optimum operations of the apparatus 10.

Figure 3:
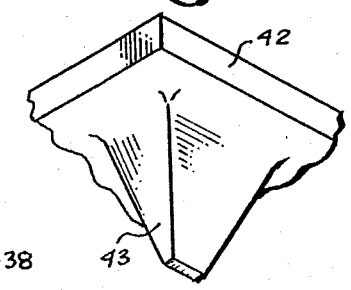
FIG. 3 is a partial view of a breaker bar tooth showing the preferred shape thereof.
Figure 4:
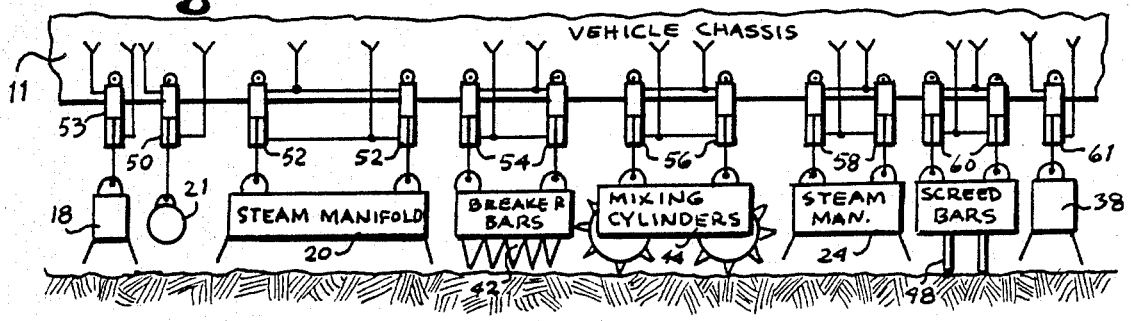
FIG. 4 is schematic view of the apparatus of FIG. 1 showing the manner in which each of the operative elements is controlled in height above the road surface by means of hydraulic cylinders.

In FIG. 3, a partial view of a breaker bar 42 is shown indicating the preferred shape for teeth 43. The pyramidal shape provides adequate strength for the tooth to minimize breakage Turning now to FIG. 4, a schematic diagram is shown illustrating the method of vertical adjustments of the various elements. Although the vertical adjustments may be made utilizing mechanical means such as lead screws, I prefer to use a hydraulic system and to operate the vertical controls through the use of a plurality of hydraulic cylinders. As may be noted from FIG. 4, each element has its own independent hydraulic cylinders For example, exhaust manifold 18 is controlled by two hydraulic cylinders 53 with only one shown for simplicity. It will be understood that the remainder of the elements include additional hydraulic cylinders not shown. Burner 22 is operated by a set of hydraulic cylinders 50 and steam manifold 20 is operated by a set of hydraulic cylinders 52. Similarly, breaker bars 42 are vertically controlled by a set of hydraulic cylinders 54, mixing cylinders 44 by a set of hydraulic cylinders 56 and steam manifold 24 by a set of hydraulic cylinders 58. Screed bars 48 are controlled by a set of hydraulic cylinders 60 and rear exhaust manifold 38 is controlled by a set of hydraulic cylinders 61.

Figure 5:
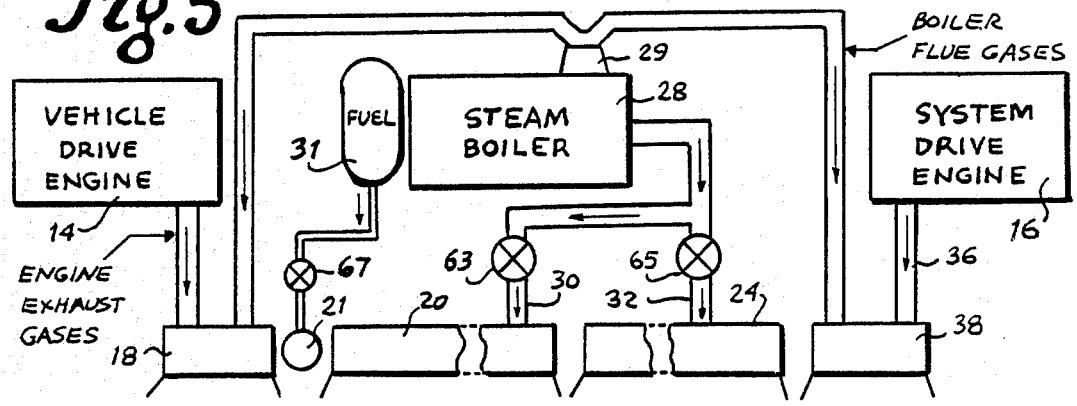
FIG. 5 is a schematic diagram showing the use of energy in practicing the method of my invention in which otherwise wasted heat from the vehicle drive engine, from the system drive engine, and from the steam boiler flue gases is effectively utilized.

FIG. 5 shows a schematic diagram of the distribution of heat in my invention to the pavement being reworked. Front exhaust manifold 18 may be noted to fed by engine exhaust gases from vehicle drive engine 14 and also from the boiler flue gases from steam boiler 28 via flue 29. Similarly, rear exhaust manifold 38 utilizes engine exhaust gases from the system drive engine 16 and also boiler flue gases from flue 29. Therefore, in accordance with my invention, all of the normally wasted energy is applied to the pavement and performs useful work thereon. Steam from steam boiler 28 is fed to both forward steam manifold 20 and rear steam manifold 24 via control valves 63 and 65. Burner 21 is fed propane or similar fuel from fuel tank 31 via control valve 67.

Figure 6:
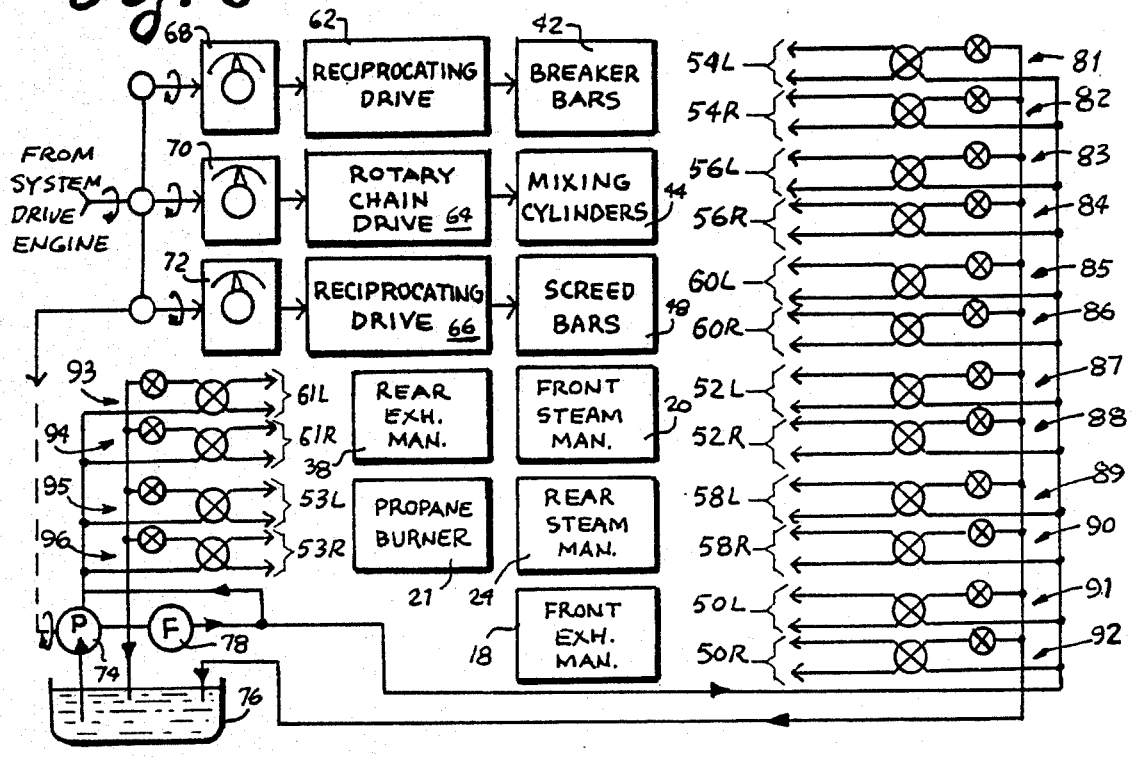
FIG. 6 is a schematic diagram of the driving and control systems for operating the various devices of the apparatus and for controlling their speeds and positions.

It is necessary in the operation of my invention to properly adjust the various elements to produce the most efficient operation. For example, the various manifolds and the burner must be controlled to raise the temperature of the asphalt to a value not to exceed 500° F. so as to not further damage the asphalt due to oxidation. The vertical position of the various elements will therefore depend upon tee forward speed of the apparatus 10 as well as the amount of fuel fed to the burner 21 and the amount and quality of the steam fed to the steam manifolds 20 and 24. With respect to the breaker bars 42, the mixing cylinders 44, and the screed bars 48, the operating speed of these elements must also be controlled to produce the optimum results. In FIG. 6, a schematic diagram of the preferred control system of the invention is shown. The system drive engine is connected to drive three variable speed gear boxes 68, 70, and 72 and hydraulic pump 74. Gearbox 68 furnished power to the reciprocating drive 62 for breaker bars 42. Variable speed transmission 70 provides power to the rotary chain drive 64 which operates mixing cylinders 44, and variable speed drive 72 operates the reciprocating drive 66 for screed bars 44. A plurality of height controls 81–96 is provided with each control having a reversing valve and a flow valve. As will be noted, I provide a separate control for the hydraulic cylinders on the left side of tee vehicle and the right side of the vehicle. This permits the adjustment of the elements to compensate for any slope of the pavement. For example, control 81 controls the height of the left side of breaker bars 42 above the pavement while controls 82 controls the height of the right side of breaker bars 42. Thus, great flexibility is given to the operator to adjust for any irregularities in the pavement. Hydraulic fluid is drawn from reservoir 76 by pump 74 via filter 78 to the height controls 91–96 with line 80 providing a return line to reservoir 76.

As may now be recognized, I have disclosed a method and apparatus for resurfacing asphalt pavements, parking lots and the like quickly and economically, using fresh asphalt from below the pavement surface, mixed with broken up surface material which may be oxidized. Although I have shown a preferred embodiment of the apparatus of my invention, it will be obvious to those of ordinary skill in the art to modify my embodiment without departing from the spirit and scope of the invention.

I claim:

1. A method of renewing an asphalt pavement having a thin degraded surface portion over an underlying thick undegraded portion comprising the steps of:

heating the surface of the asphalt pavement to a temperature in the range of 300°–500° F.;

breaking the thin degraded surface portion of the heated asphalt;

breaking the underlying undegraded portion to a depth of about two inches;

mixing the broken degraded surface portions with the broken undegraded portions from below such degraded surface portion in situ;

reheating the mixed broken portions of degraded and undegraded asphalt material to fuse the mixture into a homogeneous mass;

leveling the mixed and reheated mass by screeding; and compacting the smoothed, mixed, and reheated material.

2. A method as defined in claim 1 in which the heating step and the reheating step include the steps of:

supplying heat to the surface and mixed asphalt material with steam heat.

3. A method as defined in claim 2 which further includes:

supplying heat to the surface and mixed asphalt material from an engine exhaust.

4. Apparatus for traversing, renewing and resurfacing in situ an asphalt pavement having a thin degraded surface portion over an underlying thick undegraded portion without requiring the addition of new materials comprising:

steam generation and heating means for heating said asphalt pavement to a temperature in the range of 300–500 degrees F.;

asphalt breaking means for breaking said degraded portion of said asphalt pavement and further breaking said undegraded portion of said asphalt pavement to a depth of about two inches thereby producing broken portions of degraded and undegraded asphalt;

mixing means for producing an in situ mixture of said degraded and undegraded broken portions;

reheating means for reheating said mixture of degraded and undegraded broken portions thereby fusing said mixture into a homogeneous mass; and screeding means for leveling said homogeneous mass.

5. The apparatus as defined in claim 4 which further comprises:

a wheeled chassis having said steam generation means, said breaking means, said heating means, said screeding means, and said compacting means mounted thereon; and driving means coupled to said chassis for moving said apparatus along said pavement.

6. The apparatus as defined in claim 5 in which said asphalt breaking means includes toothed breaker bars depending from said chassis, said breaker bars reciprocating in a direction transverse to said chassis and adjustable vertically to break up the asphalt surface to said depth after heating of said surface by said first steam manifold.

7. The apparatus as defined in claim 5 in which said mixing means includes at least one rotating cylinder depending from said chassis and adjustable vertically, the surface of said cylinder having a multiplicity of toothed projections therefrom.

8. The apparatus as defined in claim 5 in which said screeding means includes transversely reciprocating screed bars dependent from said chassis and vertically adjustable, said screed bars adjusted to level the reheated and mixed asphalt to thereby produce a fresh, level asphalt surface.

9. The apparatus as defined in claim 5 which further comprises:

a gas burner means disposed forward of steam generation means on said chassis for burning off oil film from said asphalt pavement, the intensity of said burner controlled relative to the forward speed of said chassis to prevent oxidation of said asphalt pavement surface.

10. The apparatus as defined in claim 5 in which said steam generation means includes:

a steam boiler mounted on said chassis; and first steam manifold connected to receive steam from said steam boiler, said first steam manifold depending from said chassis and vertically adjustable, said steam manifold serving to raise the temperature of said asphalt pavement to a temperature within the range of 300°–500° F.

11. The apparatus as defined in claim 10 in which said reheating means includes second steam manifold connected to receive steam from said steam boiler, said second manifold depending from said chassis and vertically adjustable to reheat the broken and mixed asphalt material up to the range of 300°–500° F.

12. An apparatus for traversing, renewing and resurfacing an asphalt pavement in situ having a thin degraded surface portion over an underlying thick undegraded portion without adding new materials comprising:

a wheeled chassis;

an engine mounted on said chassis for driving said apparatus along the asphalt pavement;

a steam boiler mounted on said chassis;

first steam manifold connected to receive steam from said steam boiler, said first steam manifold depending from said chassis and vertically adjustable, said steam manifold serving to raise the temperature of said asphalt pavement to a temperature within the range of 300°–500° F.;

an exhaust manifold dependent from said chassis and disposed forward of said first steam manifold, said exhaust manifold connected to the exhaust of said driving engine, said exhaust manifold for utilizing exhaust heat for preheating the asphalt surface;

asphalt breaking means disposed immediately rearward from said first steam manifold and having toothed breaker bars depending from said chassis, said breaker bars reciprocating in a direction transverse to said chassis and adjustable vertically, said breaking means adapted to break up said degraded portion of said asphalt pavement and breaking said undegraded portion of said asphalt pavement to a depth of about two inches after heating of said surface by said first steam manifold, thereby producing broken portions of degraded and undegraded asphalt;

at least one rotating cylinder disposed immediately rearward from said breaking means depending from said chassis and adjustable vertically, the surface of said cylinder having a multiplicity of toothed projections therefrom for producing an in situ mixture of said degraded and undegraded broken portion;

second steam manifold connected to receive steam from said steam boiler, said second manifold depending from said chassis immediately rearward from said rotating cylinder and vertically adjustable to reheat the broken and mixed asphalt material to a temperature within the range of 300°–500° F.; and transversely reciprocating screed bars disposed immediately rearward from said second steam manifold and dependent from said chassis and vertically adjustable, said screed bars adjusted to level the reheated and mixed asphalt to thereby produce a fresh, level asphalt surface.

* * * * *